US010959483B1

(12) United States Patent
Baichu

(10) Patent No.: US 10,959,483 B1
(45) Date of Patent: Mar. 30, 2021

(54) WALKING FOOT SPA SYSTEM

(71) Applicant: Tony Baichu, Burnaby (CA)

(72) Inventor: Tony Baichu, Burnaby (CA)

( * ) Notice: Subject to any disclaimer, the term of this patent is extended or adjusted under 35 U.S.C. 154(b) by 104 days.

(21) Appl. No.: 16/223,734

(22) Filed: Dec. 18, 2018

(51) Int. Cl.

| | |
|---|---|
| ***A43B 7/14*** | (2006.01) |
| ***A61H 35/00*** | (2006.01) |
| ***A43B 7/12*** | (2006.01) |
| *A47K 3/022* | (2006.01) |

(52) U.S. Cl.
CPC ..... *A43B 7/146* (2013.01); *A43B 7/12* (2013.01); *A61H 35/006* (2013.01); *A47K 3/022* (2013.01); *A61H 2205/12* (2013.01)

(58) Field of Classification Search
CPC ... A61H 35/006; A61H 2205/12; A47K 3/022
See application file for complete search history.

(56) References Cited

U.S. PATENT DOCUMENTS 426,495 A * 4/1890 Falkner ..... A43B 7/06 36/3 R
438,931 A * 10/1890 Martinot ..... A61H 35/006 4/622
850,603 A * 4/1907 Reiter ..... A61H 35/006 4/622
1,060,236 A * 4/1913 Dodge ..... A61H 35/006 4/622
1,380,879 A * 6/1921 Young ..... A43B 17/06 36/3 R
3,026,540 A * 3/1962 Barker ..... A61H 35/006 4/622
3,055,357 A * 9/1962 Redka ..... A61H 35/006 601/46
3,478,738 A * 11/1969 Cox ..... A43B 7/02 601/166
3,848,588 A * 11/1974 Miquel ..... A61N 2/002 601/78
3,888,242 A * 6/1975 Harris ..... A61H 9/0078 601/152
4,694,831 A * 9/1987 Seltzer ..... A43B 7/00 15/227
4,760,655 A * 8/1988 Mauch ..... A43B 7/1425 36/141
4,841,648 A * 6/1989 Shaffer ..... A43B 7/1465 36/145
4,989,589 A * 2/1991 Pekanmaki ..... A61H 9/0078 601/150
5,074,285 A * 12/1991 Wright ..... A61H 9/0078 601/15
5,235,761 A * 8/1993 Chang ..... A43B 1/0072 36/137
5,357,693 A * 10/1994 Owens ..... A61F 7/02 36/136

(Continued)

*Primary Examiner* — Jocelyn Bravo
(74) *Attorney, Agent, or Firm* — Cramer Patent & Design, PLLC; Aaron R. Cramer

(57) ABSTRACT

A system for the treatment of a foot includes a waterproof boot capable of receiving an insert with a plurality of nozzles and a dispensing ring. The insert can receive a human foot to be treated therein. The plurality of nozzles and dispensing ring are each in fluid communication with a pump, when energized, delivers a continuous flow of a fluid therethrough. In a preferred embodiment, the fluid is a medicinal, toxin extracting fluid.

20 Claims, 4 Drawing Sheets

(56) References Cited

U.S. PATENT DOCUMENTS 5,396,896 A * 3/1995 Tumey ..... A61H 9/0078 128/925
5,682,690 A * 11/1997 Chang ..... A43B 7/00 36/11.5
5,689,902 A * 11/1997 Juang ..... A43B 21/32 36/141
5,826,349 A * 10/1998 Goss ..... A43B 7/081 36/3 R
5,836,899 A * 11/1998 Reilly ..... A43B 3/0005 601/46
5,860,229 A * 1/1999 Morgenstern ..... A43B 7/1465 36/141
5,979,086 A * 11/1999 Vindriis ..... A43B 7/1415 36/153
6,196,556 B1 * 3/2001 Bonaventure ..... A43B 5/165 280/11.202
6,258,048 B1 * 7/2001 Montague ..... A61H 7/001 601/115
6,415,529 B1 * 7/2002 Kelley ..... A43B 3/0031 36/2.6
6,464,654 B1 * 10/2002 Montgomery ..... A43B 7/00 601/1
6,691,432 B2 * 2/2004 Masseron ..... A43B 13/12 36/141
6,715,221 B1 * 4/2004 Sasaki ..... A43B 1/0045 36/141
7,073,798 B1 * 7/2006 Bonaventure ..... A43B 5/165 280/11.202
7,107,706 B1 * 9/2006 Bailey, Sr. ..... A43B 3/0005 36/29
7,163,517 B2 * 1/2007 Liu ..... A43B 3/0005 601/15
7,231,730 B1 * 6/2007 Ryan ..... A61H 7/001 36/141
7,264,599 B1 * 9/2007 Milligan ..... A43B 3/0005 36/141
7,347,831 B2 * 3/2008 Chiu ..... A43B 3/0005 36/141
7,487,606 B2 * 2/2009 Koo ..... A43B 1/0054 36/141
7,614,168 B1 * 11/2009 Zummer ..... A61H 15/0078 36/141
7,815,581 B1 * 10/2010 Sung ..... A61H 35/00 601/2
7,832,124 B2 * 11/2010 Blockton ..... A61H 23/0263 36/136
8,162,860 B1 * 4/2012 Ali ..... A61H 15/0078 601/115
8,322,055 B1 * 12/2012 Saint-Cyr ..... A43B 3/0005 36/141
8,458,930 B2 6/2013 Ha
8,615,905 B1 * 12/2013 Szabo ..... A43B 7/146 36/141
8,632,481 B2 * 1/2014 Shi ..... A43B 3/0015 601/78
8,667,708 B2 * 3/2014 Tsiantos ..... A43B 3/0005 36/3 B
8,844,166 B2 * 9/2014 Jazdanian ..... A43B 3/0005 36/43
10,136,699 B1 * 11/2018 Tse ..... A43B 1/0054
10,455,890 B2 * 10/2019 Huang ..... A61H 39/04
10,492,985 B2 * 12/2019 Golan ..... A61H 23/02
10,555,577 B2 * 2/2020 Omoruyi ..... A43B 23/025
10,675,209 B1 * 6/2020 Stroud, Jr. ..... A61H 9/0071
10,758,000 B2 * 9/2020 Naiker ..... A61H 7/004
10,786,036 B2 * 9/2020 Cheung ..... A43B 7/082
10,799,415 B2 * 10/2020 Mayer ..... A43B 7/146
2002/0091344 A1 * 7/2002 Thomas ..... A61H 9/0078 601/148
2004/0064974 A1 4/2004 Schuster
2004/0082886 A1 * 4/2004 Timpson ..... A61H 23/02 601/15
2004/0093766 A1 * 5/2004 Hahn ..... A43B 7/081 36/141
2004/0111924 A1 * 6/2004 Riccardi ..... A43B 7/146 36/141
2004/0199093 A1 * 10/2004 Jones ..... A61H 7/002 602/3
2005/0043672 A1 * 2/2005 Piuk ..... A61H 33/14 604/23
2005/0091880 A1 * 5/2005 Harris ..... A43B 3/0005 36/2.6
2005/0107725 A1 * 5/2005 Wild ..... A61H 9/0078 601/152
2006/0036197 A1 * 2/2006 Liu ..... A43B 7/00 601/15
2006/0235465 A1 * 10/2006 Koo ..... A43B 1/0054 606/204
2007/0022632 A1 * 2/2007 Lan ..... B29D 35/142 36/43
2007/0089319 A1 * 4/2007 Liao ..... A43B 7/081 36/3 R
2008/0005936 A1 * 1/2008 Chiu ..... A43B 7/146 36/3 B
2008/0010851 A1 * 1/2008 Avanzini ..... A61H 7/001 34/90
2008/0010868 A1 * 1/2008 Tsai ..... A43B 1/0081 36/141
2008/0097263 A1 * 4/2008 Grigoriev ..... A43B 7/00 601/151
2008/0132811 A1 * 6/2008 Yang ..... A61F 5/14 601/30
2008/0161734 A1 * 7/2008 Blockton ..... A43B 7/147 601/70
2009/0038179 A1 * 2/2009 Chen ..... A43B 7/146 36/41
2010/0094184 A1 * 4/2010 Wong ..... A61H 9/0078 601/149
2010/0229884 A1 * 9/2010 Alony ..... A45D 29/04 132/73.5
2011/0056092 A1 * 3/2011 Tsiantos ..... A43B 7/081 36/103
2012/0030970 A1 * 2/2012 Kim ..... A43B 1/0054 36/25 R
2012/0186101 A1 * 7/2012 Sanchez ..... A43B 3/0005 36/44
2012/0260531 A1 * 10/2012 Shi ..... A43B 7/04 36/102
2015/0313310 A1 * 11/2015 Okamoto ..... A43B 13/184 36/31
2016/0051400 A1 * 2/2016 Ruetenik ..... A61H 35/006 601/15
2016/0206043 A1 * 7/2016 Cohen ..... A43B 7/146
2016/0270479 A1 * 9/2016 Suzuki ..... A43B 11/00
2017/0042765 A1 * 2/2017 Song ..... A43B 17/00
2017/0164899 A1 * 6/2017 Yang ..... A43B 7/146
2017/0196300 A1 * 7/2017 Huang ..... A61H 39/04
2017/0251753 A1 * 9/2017 Meschter ..... A43B 13/187
2017/0265563 A1 * 9/2017 Ma ..... A43B 3/0005
2017/0303635 A1 * 10/2017 Kazarian ..... A43B 13/226
2018/0035750 A1 * 2/2018 Fanaian ..... A43B 17/003
2018/0140041 A1 * 5/2018 Comstock ..... A43B 13/04
2018/0199661 A1 * 7/2018 Ma ..... A43B 7/00
2018/0310661 A1 * 11/2018 Cothren ..... A43B 17/08
2018/0343971 A1 * 12/2018 Aggarwal ..... A43B 7/147
2019/0045883 A1 * 2/2019 Wu ..... A43B 17/006
2019/0282435 A1 * 9/2019 Lin ..... A43B 7/149
2020/0037700 A1 * 2/2020 Naiker ..... A43B 7/02
2020/0215388 A1 * 7/2020 Nixon ..... A61H 23/04
2020/0230014 A1 * 7/2020 Kim ..... B25J 9/0006
2020/0246170 A1 * 8/2020 Benenati ..... A61F 2/70

* cited by examiner

WALKING FOOT SPA SYSTEM

FIELD OF THE INVENTION

The presently disclosed subject matter is directed to a walking foot spa.

BACKGROUND OF THE INVENTION

Many people have found that relaxation is greatly enhanced by a personal massage. While these massages can be virtually applied anywhere on the human body, an area that is often massaged is the foot area. It seems that direct and firm massage here is most likely to reduce muscle aches and pains and possible even reduce stress and strain. If nothing else, it just feels good.

While many people massage their feet immediately after removing their shoes, it is usually only for a limited time, and thus the beneficial results are short-lived. While large-scale massaging devices to exist, they are not specifically designed for the foot area, and cannot be used while performing other activities. Accordingly, there exists a need for a means by which one's feet can be massaged in a soothing and relaxing manner, while not encumbering the user from performing other activities. The development of the Acupressure Footwear fulfills this need.

SUMMARY OF THE INVENTION

The principles of the present invention provide for a foot spa, comprises an insert receiving a human foot. The insert is a unitary molded clog-type of slipper-type of shoe to securely retain the human foot of a wearer inside. An outer contour of the insert is shaped to either conform to or enable proper and snug insertion and retention thereof within a boot interior. The insert is properly placed and aligned when an insert outsole rests upon a boot footbed. The insert outsole is continuous and forms a bottom of the insert, an insert sidewall is attached along all perimeter bottom edges to the insert outsole, and has an upper opening towards rear thereof, providing environmental communication with an insert interior, affixed to an interior surface of the insert sidewall is a plurality of spray tubing having a plurality of spray apertures formed therein and an insert toe cap located at a fore of the insert sidewall and an insert heel is located at a rear of the insert sidewall. The insert toe cap and the insert heel are continuous with, and are sections of, and the insert sidewall, an inlet port is in fluid communication with the inlet of the pump via an inlet tubing and an outlet port is in fluid communication with the outlet of the pump via an outlet tubing, embedded within the insert footbed is a plurality of nozzles.

The foot spa also comprises a boot which receives the insert either while the human foot is within the insert. The boot has a boot upper, a boot lower, and a boot interior, and is available in either a right foot configuration, a left foot configuration, or a universal configuration. The boot upper and the boot lower has a continuous sidewall.

The foot spa also comprises a pump in fluid communication with the insert or delivering a pressurized dispensing of a composition within the insert interior and ostensibly against the human foot of a wearer when within the insert. The composition must be large enough to pool or collect in the insert interior to provide adequate head pressure to enable the pump to operate without cavitation. The pump is sized and rated to enable a continuous transfer of the composition with the insert interior. The boot lower has a sidewall continuous with the boot upper and comprises a boot heel at a rear section, a boot toe cap at a front section, a boot front outsole, located generally subjacent the boot toe cap, and a boot rear outsole, discontinuous with the boot front outsole, generally located subjacent the boot heel.

The foot spa also comprises a tubing port located at the boot heel in environmental communication with the boot interior. The boot lower also incorporates the boot footbed, upon which the insert is placed. The boot footbed is of a height that enables the inlet port and the outlet port of the insert to be in fluid communication with the tubing port of the boot, and a sealing grommet is provided about the inner circumference of the tubing port to enable the inlet tubing and the outlet tubing to pass, yet also provide a seal from the boot interior to the environment to prevent any of the composition from passing therethrough.

The spray apertures may be located on the spray tubing such that they face the insert interior and may be equidistantly spaced thereon the spray tubing or spaced apart in any other location. The spray tubing may also be located adjacent the upper perimeter of the insert sidewall and is a continuous ring encircling the interior surface of the insert sidewall or bisected into two separate pieces of spray tubing and may further be in fluid communication with a spray manifold which is located within the insert heel. The insert interior is defined as encompassing an area bounded by the insert sidewall, a planar area intersecting an uppermost perimeter edge of the insert sidewall and the insert footbed.

The nozzles may be arranged in a pattern reflecting that of a common reflexology chart and may be arranged in a symmetrical grid-like pattern. The nozzles may conform to a human sole and may have upstanding protrusions from the insert footbed and are identical in size and shape. However, the nozzles may be unique in size and shape. The nozzles could also be flexible and rounded off in order to have a non-penetrative and massaging effect on the sole of the foot when placed therein or trod upon. The nozzles may be in fluid communication with a nozzle manifold, which is located within the insert outsole.

The nozzles each have has a dispensing orifice in fluid communication with the insert interior. The insert interior may be in fluid communication with the boot interior and the inlet port and the outlet port. The inlet port and the outlet port are located at the insert heel and adjacent the insert outsole. The insert inlet port and the insert outlet port comprise a plurality of common fluid connection fittings that are either threaded, a plurality of compression fittings, or a plurality of friction fit ports.

The boot upper may have a height able to cover most of the lower half of a leg of the wearer and has a diameter permitting easy passage of the foot of the wearer and the insert therethrough. The boot may be made of material selected from the group consisting of unitary molded material, natural rubber and synthetic rubber.

The foot spa may also require the boot, the insert, and the pump to be capable of withstanding foot spa temperature treatments, an upper perimeter edge of the boot upper has an elastic band secured thereto, with a drawstring secured therein. The distal ends of the drawstring may be exposed from an opening of the elastic band. The strap may enable the wearer to grasp the boot and aid in donning or doffing the boot. The boot heel may have a reinforcing ring or a plurality of multiple rings traversing thereabout to provide additional support and protection. The inlet tubing and the outlet tubing are constructed out of an inert, resilient, and flexible hollow fluid transfer tubing. The boot interior may be defined as encompassing an area bounded by the boot upper, a planar area intersecting with the uppermost perimeter edge of the elastic band and the boot footbed of the boot lower.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
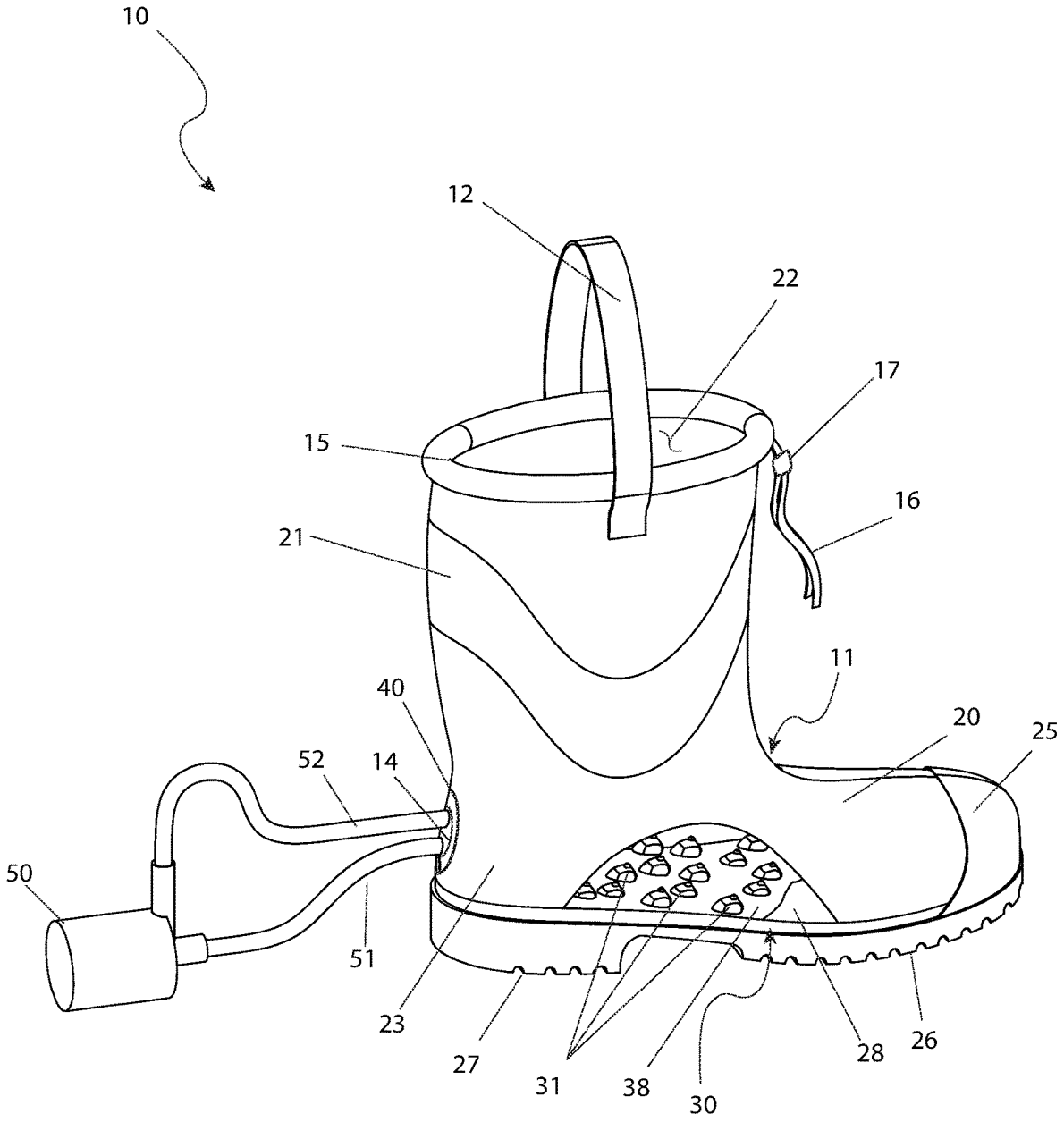
FIG. 1 is a partial cut-away perspective view of a walking foot spa toxin extractor 10, according to a preferred embodiment of the present invention.

10 walking foot spa toxin extractor
11 boot
12 strap
14 tubing port
15 elastic band
16 drawstring
17 keeper
20 boot lower
21 boot upper
22 boot interior
23 boot heel
25 boot toe cap
26 boot front outsole
27 boot rear outsole
28 boot footbed
30 foot insert
31 nozzle
32*a* spray tubing
32*b* spray aperture
33 insert toe cap
34 insert interior
35 insert heel
36 insert sidewall
37 insert outsole
38 insert footbed
40 sealing grommet
41*a* inlet port
41*b* outlet port
50 pump
51 inlet tubing
52 outlet tubing
54*a* spray manifold
54*b* nozzle manifold
54*c* insert inlet port
54*d* insert outlet port
60 toxin extracting composition

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention It is envisioned that other styles and configurations of the present invention can be easily incorporated into the teachings of the present invention, and only one particular configuration shall be shown and described for purposes of clarity and disclosure and not by way of limitation of scope. All the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a partial cut-away view of the walking foot spa toxin extractor (herein described as the "system") 10, which describes a method for immersing a foot into a composition 60 including all-natural and organic ingredients that promote toxin extraction. The system 10 includes an insert 30 capable of securely and comfortably receiving a human foot therein, a boot 11 capable of securely receiving the insert 30 therein, either while a foot is or is not within the insert 30, and a pump 50 in fluid communication with the insert 30 for delivering a pressurized dispensing of the composition 60 within the insert interior 34, and ostensibly against the foot of a user when within the insert 30. The amount of the composition 60 is limited by the user, but for proper usage of the pump 50, the composition 60 must be large enough to "pool" or collect in the insert interior 34 to provide adequate head pressure to enable the pump 50 to operate without cavitation. The exact composition 60 is also determined by the user, as well as the temperature. As such, the boot 11, insert 30, and pump 50 must be able to withstand, but not be limited to, typical foot spa temperature treatments e.g., 85° F.-120° F.

The boot 11 is preferably manufactured out a unitary molded material, such as natural or synthetic rubber. The boot 11 has expected features, such as a boot upper 21, a boot lower 20, and a boot interior 22, and is available in either a right foot configuration, a left foot configuration, or a universal configuration (e.g. able to be worn by either the right or the left foot). The boot upper 21 and boot lower 20 has a continuous sidewall. The boot upper 21 has a height able to cover most of the lower half of a leg of a user (i.e., the ankle, shin, and below-the-knee areas), and has a diameter permitting easy passage of the foot of the user and the insert 30 therethrough. The upper perimeter edge of the boot upper 21 has an elastic band 15 secured thereto, with a drawstring 16 secured therein. The distal ends of the drawstring 16 are exposed from an opening of the elastic band 15. A keeper 17 is mechanically fastened to both distal ends of the drawstring 16 and provides a secure fastening of the drawstring 16 at its desired length. Upon pulling outward of the drawstring 16, the elastic band 15 experiences a reduction in diameter, thereby tightening around the leg of the user. This aids in maintaining resistance in any composition 60 from exiting the boot 11. A strap 12 has a pair of distal ends each affixed to opposing sides of the boot upper 21 from the opening and subjacent from the elastic band 15. The strap 12 can enable a user to grasp the boot 11 and aid in donning or doffing the boot 11. In certain embodiments, the boot upper 21 is partially or fully transparent.

As mentioned above, the boot lower 20 has a sidewall continuous with the boot upper 21 and comprises a boot heel 23 at a rear section (also continuous with a the sidewall of the boot upper 21), a boot toe cap 25 at a front section, a boot front outsole 26, located generally subjacent the boot toe cap 25, and a boot rear outsole 27, discontinuous with the boot front outsole 26, generally located subjacent the boot heel, and a tubing port 14 located at the boot heel 23 in environmental communication with the boot interior 22. The boot lower 20 also incorporates a boot footbed 28, upon which the insert 30 is placed. The boot footbed 28 is of a height that enables the inlet port 41*a* and outlet port 42*b* of the insert 30 to be in fluid communication with the tubing port 14 of the boot 11. The boot heel 23 may have a reinforcing ring or multiple rings traversing thereabout to provide additional support and protection. The boot toe cap 25 may also have a reinforced area also to provide additional support and protection. A sealing grommet 40 is provided about the inner circumference of the tubing port 14 to enable the inlet tubing 51 and outlet tubing 52 to pass, yet also provide a seal from the boot interior 22 to the environment to prevent any of the composition 60 from passing therethrough. Other embodiments of the system 10 for providing a positive seal from the boot interior 22 to the environment can be a sealing fastener between the sealing grommet 40 and the insert 30.

The boot interior 22 is defined as encompassing the area bounded by the boot upper 21, a planar area intersecting with the uppermost perimeter edge of the elastic band 15, and the boot footbed 28 of the boot lower 20. The boot interior 22 is envisioned to be in fluid communication with the insert interior 34 and able to contain a certain volume of the composition 60.

Figure 2:
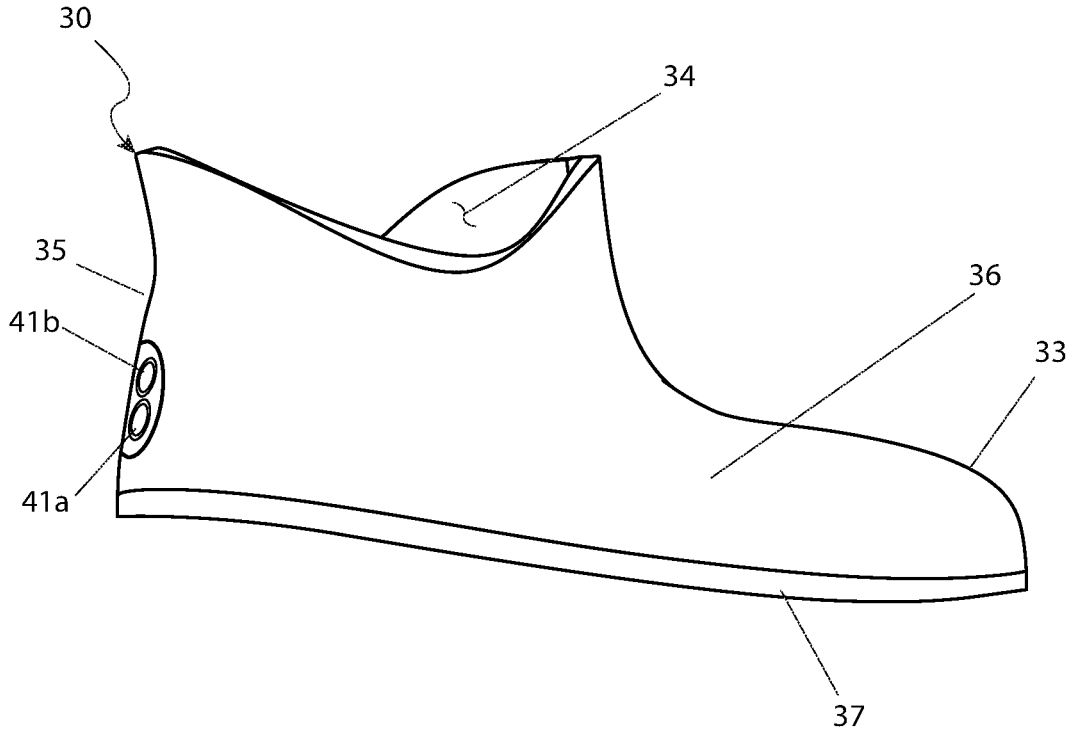
FIG. 2 is a side elevation view of a foot insert 30, according to the preferred embodiment of the present invention.
Figure 3:
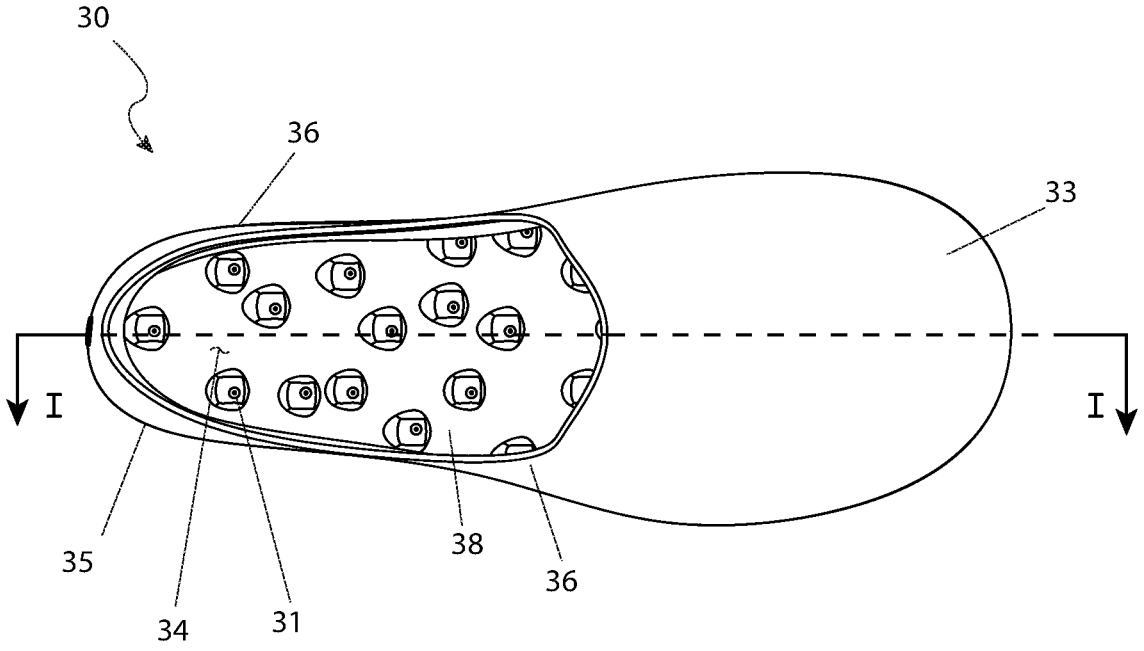
FIG. 3 is a top plan view of the foot insert 30, according to the preferred embodiment of the present invention; and, FIG. 4 is a cut-away view of the foot insert 30 taken along the section line I-I (see FIG. 3), according to the preferred embodiment of the present invention; and, FIG. 5 is a process flow diagram of the walking foot spa 10, according to the preferred embodiment of the present invention.

Referring now to FIGS. 2 and 3, which illustrate a side elevation and a top plan view of a preferred embodiment of the insert 30. The insert 30 is preferably a unitary molded "clog"-type of slipper-type of shoe that is configured to securely retain a foot of a user therein but does not have any fasteners. The outer contour of the insert 30 is shaped to either conform to or enable proper and snug insertion and retention thereof within the boot interior 22. The insert 30 is properly placed and aligned when the insert outsole 37 rests upon the boot footbed 28. The insert outsole 27 is continuous and forms the bottom of the insert 30. An insert sidewall 36 is attached along all perimeter bottom edges to the insert outsole 37, and has an upper opening towards the rear thereof, providing environmental communication with the insert interior 34. An insert toe cap 33 is located at the fore of the insert sidewall 36 and an insert heel 35 is located at the rear of the insert sidewall 26. An insert footbed 38 is located opposite the interior outsole 37. As such, the insert toe cap 33 and insert heel 35 are continuous with, and are sections of, the insert sidewall 36. The insert interior 34 is defined as encompassing the area bounded by the insert sidewall 36, a planar area intersecting the uppermost perimeter edge of the insert sidewall 36, and the insert footbed 38. The insert interior 34 is envisioned to be in fluid communication with the boot interior 22 and the inlet port 41*a* and outlet port 41*b*. Both the inlet port 41*a* and outlet port 41*b* are located at the insert heel 35 and adjacent the insert outsole 37. Also, both the insert inlet port 41*a* and insert outlet port 41*b* comprise common fluid connection fittings, that are either threaded, compression fittings, or mere friction fit ports.

Figure 4:
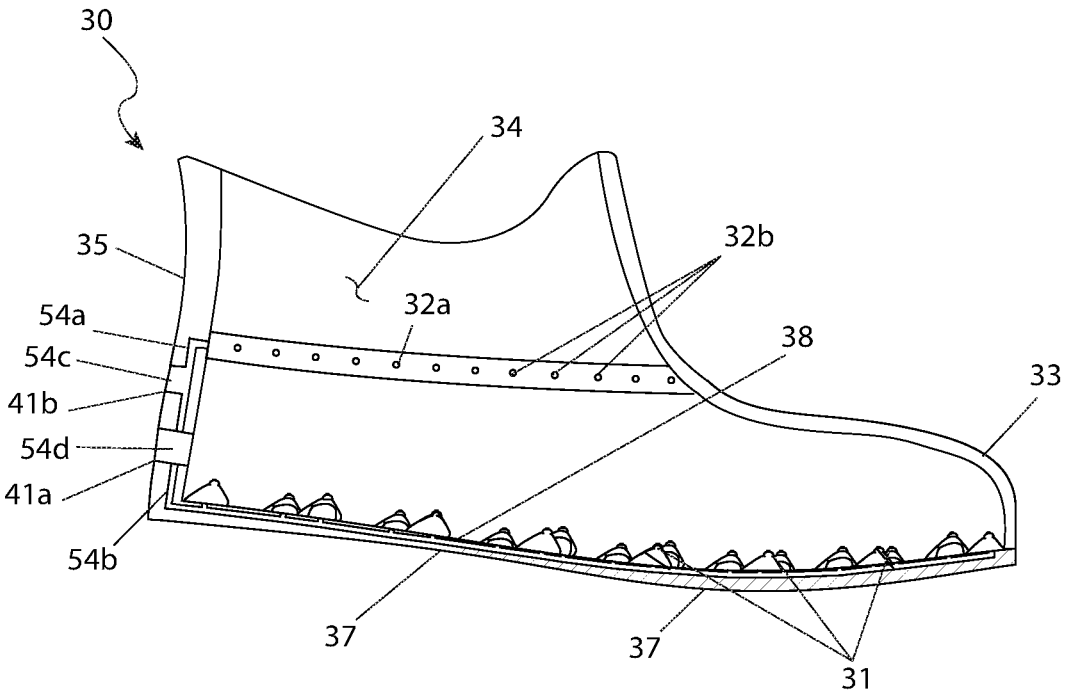
Figure 5:
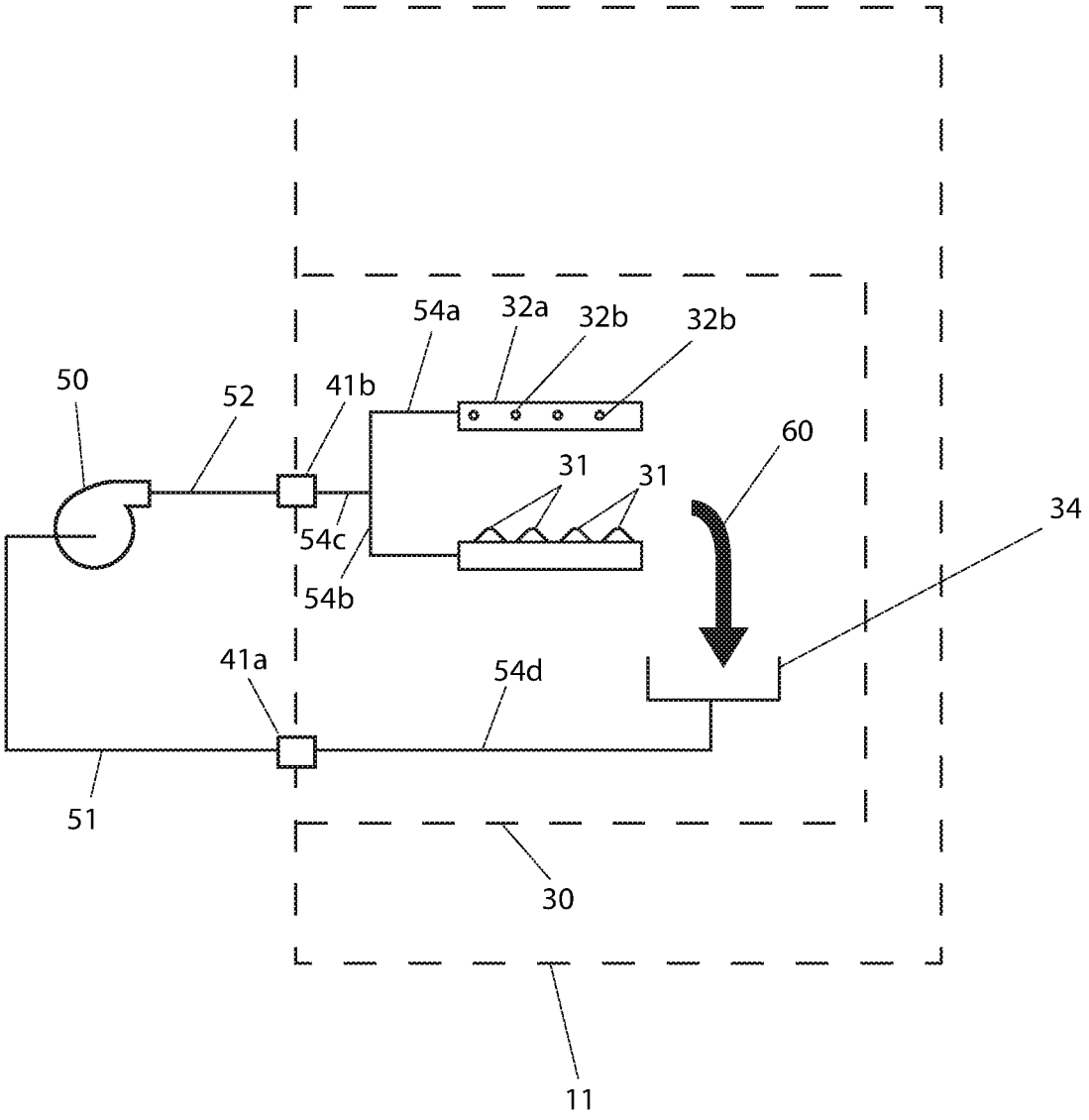

Referring more closely now to FIGS. 4 and 5, a cut-away view of the insert 30 and a process flow diagram of the system 10, is illustrated herein. Embedded within the insert footbed 38 is a plurality of nozzles 31. The plurality of nozzles 31 in a preferred embodiment are arranged in a pattern reflecting that of common reflexology charts. The number of nozzles 31 and placements thereof can differ according to the reflexology chart being used, or the nozzles 31 can be arranged in a grid-like pattern, either symmetrical or conforming to a typical human sole. The nozzles 31 are upstanding protrusions from the insert footbed 38, and can be identical in size and shape, or each nozzle 31 can be unique in size and shape. The nozzles 31 are preferably integrally formed with the insert 30, or at least the insert footbed 38, and are therefore preferably identical in in material of construction. The nozzles 31 are flexible and rounded off in order to have a non-penetrative and massaging effect on the sole of the foot when placed therein or trod upon. Each nozzle 31 is in fluid communication with a nozzle manifold 54*b*, which is located within the insert outsole 37. Each nozzle 31 has a dispensing orifice in fluid communication with the insert interior 34.

Embedded within, or alternately affixed to an interior surface of the insert sidewall 36, is spray tubing 32*a*, having a plurality of spray apertures 32*b* formed therein. The spray apertures 32*b* are located on the spray tubing 32*a* such that they face the insert interior 34. The spray apertures 32*b* may be equidistantly spaced thereon the spray tubing 32*a*, or spaced apart in any other location. The spray tubing 32*a* is located adjacent the upper perimeter of the insert sidewall 36 and can be a continuous ring encircling the interior surface of the insert sidewall 36 or bisected into two (2) separate pieces of spray tubing 32*a*. Other certain embodiments can provide for multiple elements of spray tubing 32*a* located at different vertical positions along the insert sidewall 36. The spray tubing 32*a* is in fluid communication with a spray manifold 54*a* located within the insert heel 35.

The inlet of both the spray manifold 54*a* and nozzle manifold 54*b* are in fluid communication with an insert inlet port 54*c*. The insert inlet port 54*c* is in fluid communication with the inlet port 41*a* located at the rear of the insert heel 35. An insert outlet port 54*d* is in fluid communication between the insert interior 34 and the outlet port 41*b*. When the insert 30 is properly inserted into the boot 11, the inlet port 41*a* and outlet port 41*b* are aligned with the tubing port 14. The spray manifold 54*a* and nozzle manifold 454*b* are simultaneously delivered fluid from the pump 50 via the insert inlet port 54*c* and outlet port 41*b*. Certain embodiments may provide for a selective distribution only to the spray manifold 54*a* or only to the nozzle manifold 54*b*.

The inlet port 41*a* is capable of being in fluid communication with the inlet of the pump 50 via inlet tubing 51. Similarly, the outlet port 41*b* is capable of being in fluid communication with the outlet of the pump 50 via outlet tubing 52. The pump 50 is sized and rated to enable a continuous transfer of the composition 60 with the insert interior 34. Such a pump can be a centrifugal pump, capable of being in electrical communication with a power source and having a power switch. Certain embodiments can also provide for a pump 50 having a variable speed transmission, thereby providing a range of fluid flow. Even another embodiment can provide for discrete speeds capable of being dialed in, to provide specific and reliable fluid flow. The inlet tubing 51 and outlet tubing 52 are constructed out of an inert, resilient, and flexible hollow fluid transfer tubing, such as Tygon®.

2. Operation of the Preferred Embodiment

The preferred embodiment of the present invention can be utilized by the common user in a simple and effortless manner with little or no training. It is envisioned that the system 10 would be constructed in general accordance with FIG. 1 through FIG. 5. The user would procure the system 10 through normal channels while ensuring that the proper size of system 10 is obtained for the size and shape (e.g., right or left) of the foot the user wishes to treat, as well as obtain the inseret 30 having the desired pattern of nozzles 31.

After procurement and prior to utilization, a desired amount, temperature, and specific ingredient list of the composition 60 is to be prepared. The user can then insert the desired foot within the insert 30, such that the sole of the foot engages or is immediately adjacent the nozzle 31. Alternately, the insert 30 can first be inserted into the boot 11. The user can then grasp the handle 12 if necessary, to insert the insert 30 with the foot already inserted into the boot 11, or alternately, their foot into the insert 30 that is already placed in the boot 11. The prepared composition 60 is then introduced into the boot 11 and insert 30. Alternately, the composition 60 can be introduced into the boot 11 and insert 30 prior to the foot of the user being inserted. The ends of the drawstring 16 can then be pulled or loosened such that the elastic band 15 snug fits about the outer circumference of the leg of the foot of the user being treated and secured with the keeper 17.

The boot 11 and insert 30 with the foot inserted therein can be used just walking around or performing normal everyday activities. During a resting period when user with the boot 11 and insert 30 is not in motion, the system 10 can be fully utilized. The pump 50 is placed near the boot 11, the inlet tubing 51 is attached to and provided fluid communication between the inlet of the pump 50 and the inlet port 41*a*, and the outlet tubing 55 is attached to and provided fluid communication between the outlet of the pump 50 and the outlet port 41*b*. The pump 50 is energized as desired. The pump 50 thereby delivers a fluid flow of the composition 60 as described earlier to the insert interior 34. The pump 50 delivers the composition 60 to the outlet tubing 52, through the outlet port 41*b*, into the insert inlet port 54*c*, and into both the spray manifold 54*a* and nozzle manifold 54*b* to deliver the composition 60 to the insert interior 34 via the spray apertures 32*b* of the spray tubing 32*a*, and the nozzles 31, respectively. The composition 60 is drawn through the insert outlet port 54*d*, inlet port 41*a*, and inlet tubing 51, and the inlet of the pump 50 for subsequent continuous delivery.

The foregoing descriptions of specific embodiments of the present invention have been presented for purposes of illustration and description. They are not intended to be exhaustive or to limit the invention to the precise forms disclosed, and obviously many modifications and variations are possible considering the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A foot spa, comprising:

an insert configured to receive a foot of a human wearer, wherein said insert is a unitary molded shoe configured to securely retain said foot within said shoe, said insert comprising:

an insert outsole, an insert footbed, and an insert sidewall; the insert sidewall comprising an insert toe cap located at a front portion of said insert sidewall, an insert heel located at a rear portion of said insert sidewall, and an upper opening towards the rear portion of the insert sidewall;

wherein said insert toe cap and said insert heel are continuous portions of said insert sidewall, the insert sidewall is attached along all perimeter bottom edges to said insert outsole, and said insert outsole is continuous and forms a bottom of said insert;

a boot capable of receiving said insert, wherein an outer contour of said insert is shaped to either conform to, or enable proper insertion and retention of the insert within, an interior of the boot, and wherein the insert outsole rests upon a footbed of the boot; said boot comprising:

a boot upper, a boot lower, a boot outsole, a boot interior, a boot toe cap, and a boot heel;

wherein said boot is formed in a right foot configuration, a left foot configuration, or a universal configuration, wherein said boot upper and said boot lower form a continuous sidewall of said boot; and wherein said boot outsole includes a boot front outsole adjacent said boot toe cap, and a boot rear outsole adjacent said boot heel, the boot front outsole and boot rear outsole being discontinuous with each other; and a pump in fluid communication with said insert and configured to deliver a pressurized dispensing of a fluid within an interior of said insert against said human foot when the insert is worn, the pump having an inlet and an outlet; wherein said fluid is configured to pool or collect in said insert interior to provide adequate head pressure to enable said pump to operate without cavitation, wherein said pump is sized and rated to enable a continuous transfer of said fluid within said insert interior;

said insert further comprising:

a plurality of spray tubing having a plurality of spray apertures, the plurality of spray tubing being affixed to an interior surface of said insert sidewall, an inlet port in fluid communication with said inlet of said pump via an inlet tubing, an outlet port in fluid communication with said outlet of said pump via an outlet tubing, and a plurality of nozzles embedded within said insert footbed;

said boot further including a tubing port located at said boot heel, said tubing port in environmental communication with said boot interior, wherein said boot footbed is of a height that enables said inlet port and said outlet port of said insert to be aligned with and in fluid communication with said tubing port of said boot, and said tubing port includes a sealing grommet around an inner circumference of said tubing port, to enable said inlet tubing and said outlet tubing to pass, yet also provide a seal from said boot interior to an external environment, to prevent any of said fluid from passing through the tubing port;

wherein said plurality of spray tubing and said plurality of nozzles are configured to deliver the pressurized dispensing of fluid from said pump to said wearer's foot.

2. The foot spa, according to claim 1, wherein said plurality of spray apertures is located on said plurality of spray tubing such that said plurality of apertures faces said insert interior.

3. The foot spa, according to claim 1, wherein said plurality of spray apertures is equidistantly spaced on said plurality of spray tubing or spaced apart ii on any other location on said insert sidewall.

4. The foot spa, according to claim 1, wherein said plurality of spray tubing is located adjacent said upper opening of said insert and either forms a continuous ring encircling said interior surface of said insert sidewall or is bisected into two separate sections of spray tubing.

5. The foot spa, according to claim 1, wherein said plurality of spray tubing is in fluid communication with a spray manifold located within said insert heel.

6. The foot spa, according to claim 1, wherein said insert interior encompasses an area bounded by said insert sidewall, a planar area intersecting an uppermost perimeter edge of said insert sidewall, and said insert footbed.

7. The foot spa, according to claim 1, wherein said plurality of nozzles is arranged in a predetermined pattern according to a reflexology chart.

8. The foot spa, according to claim 1, wherein said plurality of nozzles is arranged in a symmetrical grid-like pattern.

9. The foot spa, according to claim 1, wherein said plurality of nozzles is configured to conform to a sole of said wearer's foot.

10. The foot spa, according to claim 1, wherein said plurality of nozzles form upstanding protrusions from said insert footbed and are identical in size and shape.

11. The foot spa, according to claim 1, wherein said plurality of nozzles is unique in size and shape.

12. The foot spa, according to claim 1, wherein said plurality of nozzles is flexible and rounded off in order to have a non-penetrative and massaging effect on said sole of said foot when trod upon.

13. The foot spa, according to claim 1, wherein said plurality of nozzles is in fluid communication with a nozzle manifold, which is located within said insert outsole.

14. The foot spa, according to claim 1, wherein said plurality of nozzles each has a dispensing orifice in fluid communication with said insert interior.

15. The foot spa, according to claim 1, wherein said insert interior is in fluid communication with said boot interior and said inlet port and said outlet port.

16. The foot spa, according to claim 1, wherein said inlet port and said outlet port are located at said insert heel and adjacent said insert outsole.

17. The foot spa, according to claim 1, wherein said insert inlet port and said insert outlet port comprise a plurality of fluid connection fittings that are a plurality of threaded fittings, a plurality of compression fittings, or a plurality of friction fit ports.

18. The foot spa, according to claim 1, wherein said boot upper has a height able is configured to cover a majority of a lower half of a leg of said wearer, the boot upper having a diameter configured to permit easy passage of said foot of said wearer and said insert through the boot.

19. The foot spa, according to claim 1, wherein said boot is made of material selected from a group consisting of: unitary molded material, natural rubber and synthetic rubber.

20. The foot spa, according to claim 1, wherein:

said boot, said insert, and said pump are each configured to withstand foot spa temperature treatments;

an upper perimeter edge of said boot upper includes an elastic band and a drawstring secured within the elastic band; wherein distal ends of said drawstring are exposed via an opening of said elastic band;

the boot includes a strap configured to enable said wearer to grasp said boot and aid in donning or doffing said boot;

said boot heel further includes a reinforcing ring or a plurality of multiple rings traversing a circumference of the boot to provide additional support and protection;

said inlet tubing and said outlet tubing are constructed out of an inert, resilient, and flexible hollow fluid transfer tubing; and said boot interior encompasses an area bounded by said boot upper, a planar area intersecting with said upper perimeter edge of said elastic band, and said boot footbed.

* * * * *